US006889724B2

(12) United States Patent
Awad

(10) Patent No.: US 6,889,724 B2
(45) Date of Patent: May 10, 2005

(54) STATIONARY FLUID REPLACEMENT SYSTEM AND METHODS OF USE

(76) Inventor: Adam Awad, 160 Fairhaven La., Costa Mesa, CA (US) 92626

( * ) Notice: Subject to any disclaimer, the term of this patent is extended or adjusted under 35 U.S.C. 154(b) by 0 days.

(21) Appl. No.: 10/640,606

(22) Filed: Aug. 12, 2003

(65) Prior Publication Data

US 2004/0103955 A1 Jun. 3, 2004

Related U.S. Application Data

(63) Continuation-in-part of application No. 10/254,141, filed on Sep. 24, 2002, now Pat. No. 6,604,557.

(51) Int. Cl.[7] ..... B65B 1/04
(52) U.S. Cl. ..... 141/65; 184/1.5
(58) Field of Search ..... 141/59, 65, 67, 141/98, 192; 184/1.5

(56) References Cited

U.S. PATENT DOCUMENTS 2,020,350 A * 11/1935 Bertschinger ..... 134/111
4,095,673 A * 6/1978 Takeuchi ..... 184/1.5
5,103,878 A 4/1992 Cassia
5,615,716 A 4/1997 Akazawa
5,649,574 A 7/1997 Turcotte et al.
5,685,396 A * 11/1997 Elkin et al. ..... 184/1.5
5,845,684 A 12/1998 Fletcher, Jr. et al.
5,853,068 A * 12/1998 Dixon et al. ..... 184/1.5
6,234,215 B1 5/2001 Klamm
6,378,657 B2 * 4/2002 Viken ..... 184/1.5

FOREIGN PATENT DOCUMENTS

EP 1013908 6/2000

* cited by examiner

*Primary Examiner*—Steven O. Douglas
(74) *Attorney, Agent, or Firm*—Gene Scott; Patent Law & Venture Gp.

(57) ABSTRACT

A fluid exchange apparatus provides a stationary control station with plural first and second fluid containers mounted on top and below the control station. Conduits interconnect the fluid containers with the control station for fluid transfer and fluid interchange with an automotive vehicle or other equipment. Suction and pressure are provided for driving fluids through a fluid switching system. The control station provides dual control panels enabled for servicing two equipments simultaneously.

13 Claims, 3 Drawing Sheets

STATIONARY FLUID REPLACEMENT SYSTEM AND METHODS OF USE

RELATED APPLICATIONS

This is a continuation-in-part application of a prior filed and currently application having Ser. No. 10/254,141 filed Sep. 24, 2002 now U.S. Pat. No. 6,604,557. Other applications related to the present application, and pending on the filing date of the present application are: Ser. No. 10/266,529 filed Oct. 8, 2002, Ser. No. 10/287,574 filed Nov. 4, 2002, Ser. No. 10/634,271 filed Aug. 4, 2003 and Ser. No. 10/634,976 filed on Aug. 4, 2003. The status of these other applications on Oct. 28, 2004 is: '529-pending; '574-issued as U.S. Pat. No. 6,688,340 on Feb. 10, 2004; '271-issued as U.S. Pat. No. 6,772,803 on Aug. 10, 2004; and '976-issued as U.S. Pat. No. 6,752,181 on Jun. 22, 2004.

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to maintenance of fluid systems and more particularly to a stationary system adapted for quick replacement of fluids on plural vehicles simultaneously.

2. Description of Related Art

The following art defines the present state of this field:

Cassia, U.S. Pat. No. 5,103,878 describes a flush cap for a vehicle cooling system wherein the flush cap has an inlet through which fresh water enters and an outlet through which dirty coolant leaves. The method employs the flush cap to flush the cooling system of the vehicle. The radiator cap can be adapted to drain a radiator using a hose attached to the outlet of the cap.

Akazawa, U.S. Pat. No. 5,615,716 describes an engine coolant changing apparatus for changing an engine coolant such as LLC (long-life coolant) in an engine coolant path containing a radiator, comprising coolant storing means possessing a pressure action port and a liquid inlet and outlet, detaching mechanism to be attached or detached to or from a filler port of a radiator, communicating device for communicating between the liquid inlet and outlet and the detaching device, and pressure action device for applying a negative pressure to the pressure action port to overheat the coolant to a low temperature by driving an engine when discharging the coolant from an engine coolant system, and applying a positive pressure to the pressure action port when feeding a fresh liquid, so that the coolant can be changed promptly in a short time, without requiring manipulation of radiator drain cock or jack-up of the vehicle.

Turcotte et al., U.S. Pat. No. 5,649,574 describes a removal and refill apparatus for use in removing and/or refilling coolant in an automotive cooling system. The automotive cooling system typically includes a radiator, overflow bottle, engine, water pump, and heater core elements. A method for utilizing the coolant removal and refill apparatus utilizing vacuum and pressure is described for use with the removal and refill apparatus.

Fletcher, Jr. et al., U.S. Pat. No. 5,845,684 describes a clean and easy-to-use, portable upright apparatus, and a method for its use, which can be used to flush and fill the radiator and coolant systems of motorized vehicles in approximately 15 minutes, the apparatus comprising a self-priming pump, a waste collection tank, a tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant.

Klamm, U.S. Pat. No. 6,345,215 describes an apparatus for adding coolant to a cooling system of a motor vehicle including a cap with a resilient sleeve that expands against the inside wall of a radiator filler neck to provide an air-tight connection. A valve attached to the cap controls the flow of air and coolant through the cap. A gauge on the cap indicates the pressure inside the radiator. A venturi assembly connected to the valve provides a source of vacuum for evacuating air from the cooling system. Thereafter, coolant is drawn through the cap by the vacuum created in the system.

Gayet, EP 1013908 describes a coolant fluid replacement device for an automobile, utilizing an open loop distribution circuit within the coolant loop during the replacement of the used coolant. The coolant loop comprises a radiator that includes an inlet from the engine and an outlet to the engine. During the coolant replacement process, the device is connected between the coolant pumps of the vehicle system. The new fluid is stored in a first reservoir. As the new fluid is pumped into the system, the old fluid is forced out into a second reservoir.

The prior art teaches the use of fluid exchange systems for providing automotive maintenance and especially in the field of radiator cleaning and refilling, but does not teach a stationary system dual or plural service bays and with underground storage and above ground gravity assisted feeds. The present invention fulfills these needs and provides further related advantages as described in the following summary.

SUMMARY OF THE INVENTION

The present invention teaches certain benefits in construction and use which give rise to the objectives described below.

A fluid exchange apparatus provides a stationary control station with plural first and second fluid containers mounted above and below the control station. Conduits interconnect the fluid containers with the control station for fluid transfer and fluid interchange with an automotive vehicle. Suction and pressure are provided for driving fluids through a fluid switching system in the conduit means. The control station provides plural control panels enabled for servicing plural vehicles simultaneously, although a single control panel may be used for a single vehicle. Gravity feed into the vehicle being services and from the vehicle being services is possible by placing the supply containers above point of use and by placing drain containers below point of use. Automotive fluid systems that may enjoy the benefit of the present invention include the automotive cooling, transmission, brake and power steering systems, but is not limited thereto.

A primary objective of the present invention is to provide an apparatus and method of use of such apparatus that provides advantages not taught by the prior art.

Another objective is to provide such an invention capable of moving fluids between containers and an automotive fluid system for cleaning and refilling with only an initial vacuum drawn on one or more containers.

A further objective is to provide such an invention capable of servicing two automotive vehicles at the same time using common system elements such as a single pump.

A still further objective is to provide such an invention capable of providing replacement fluids and draining spent fluids by gravity feed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
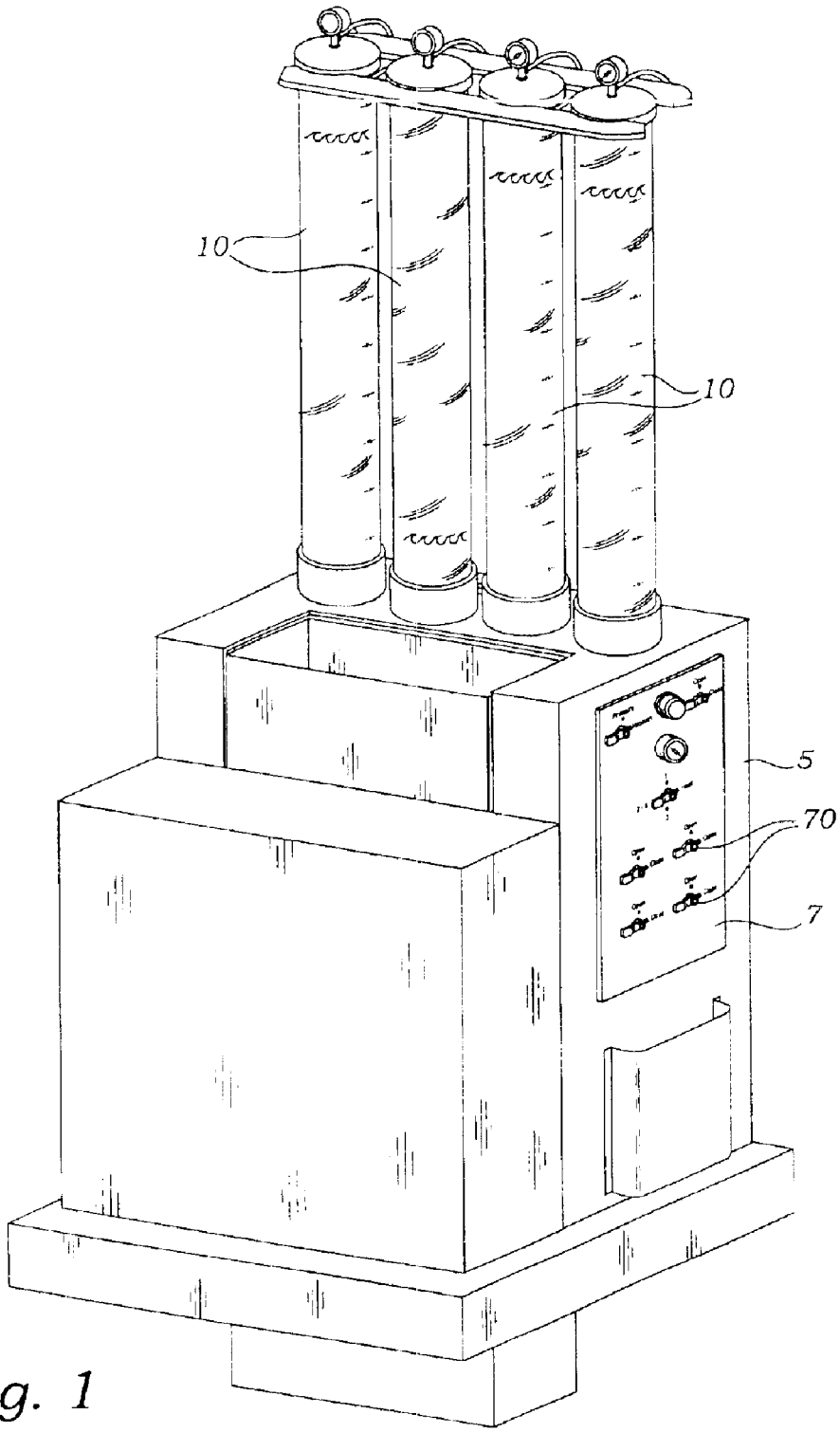
FIG. 1 is a perspective view of a preferred embodiment of a control station of the invention.
Figure 2:
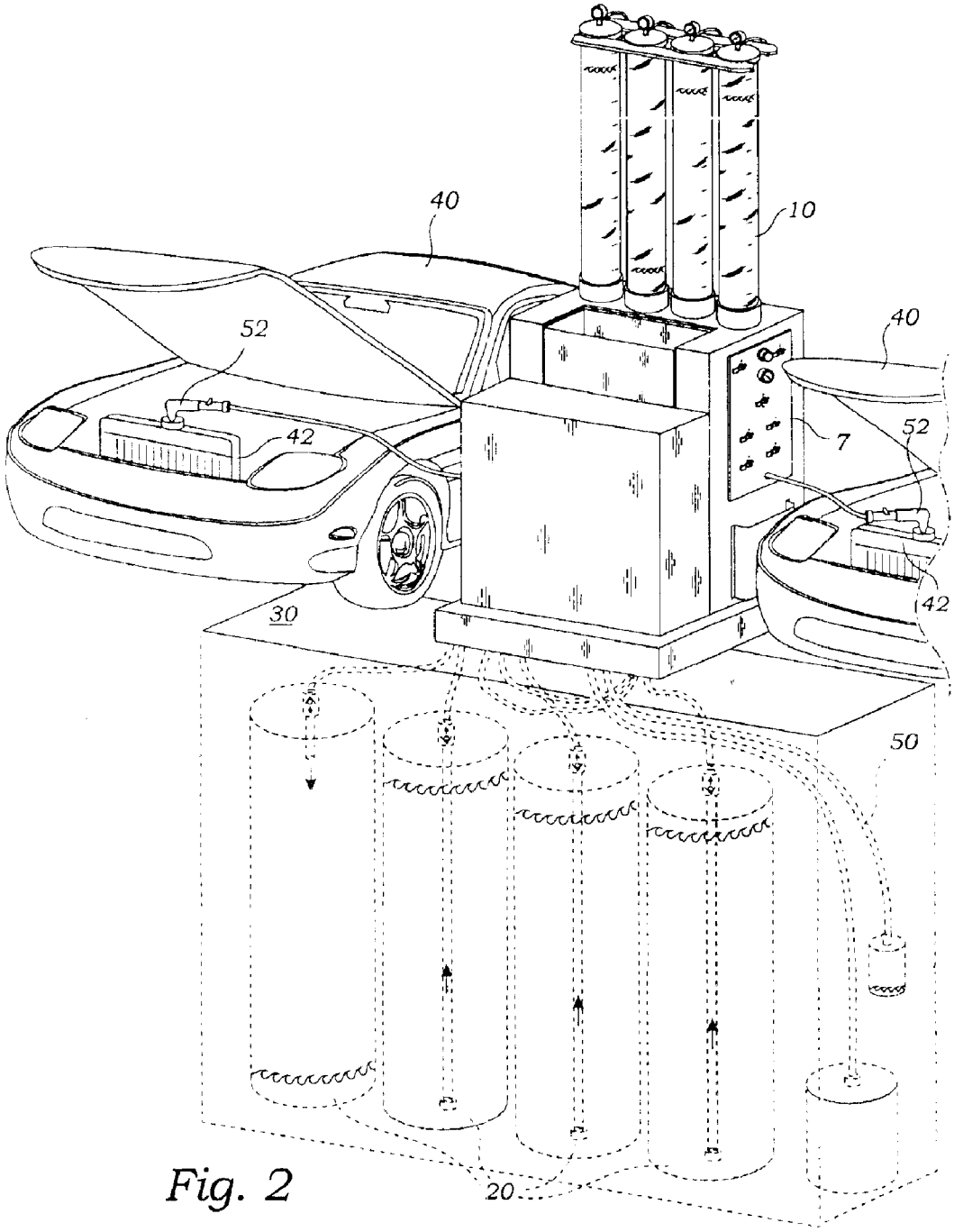
FIG. 2 is a similar view thereof showing its operation.
Figure 3:
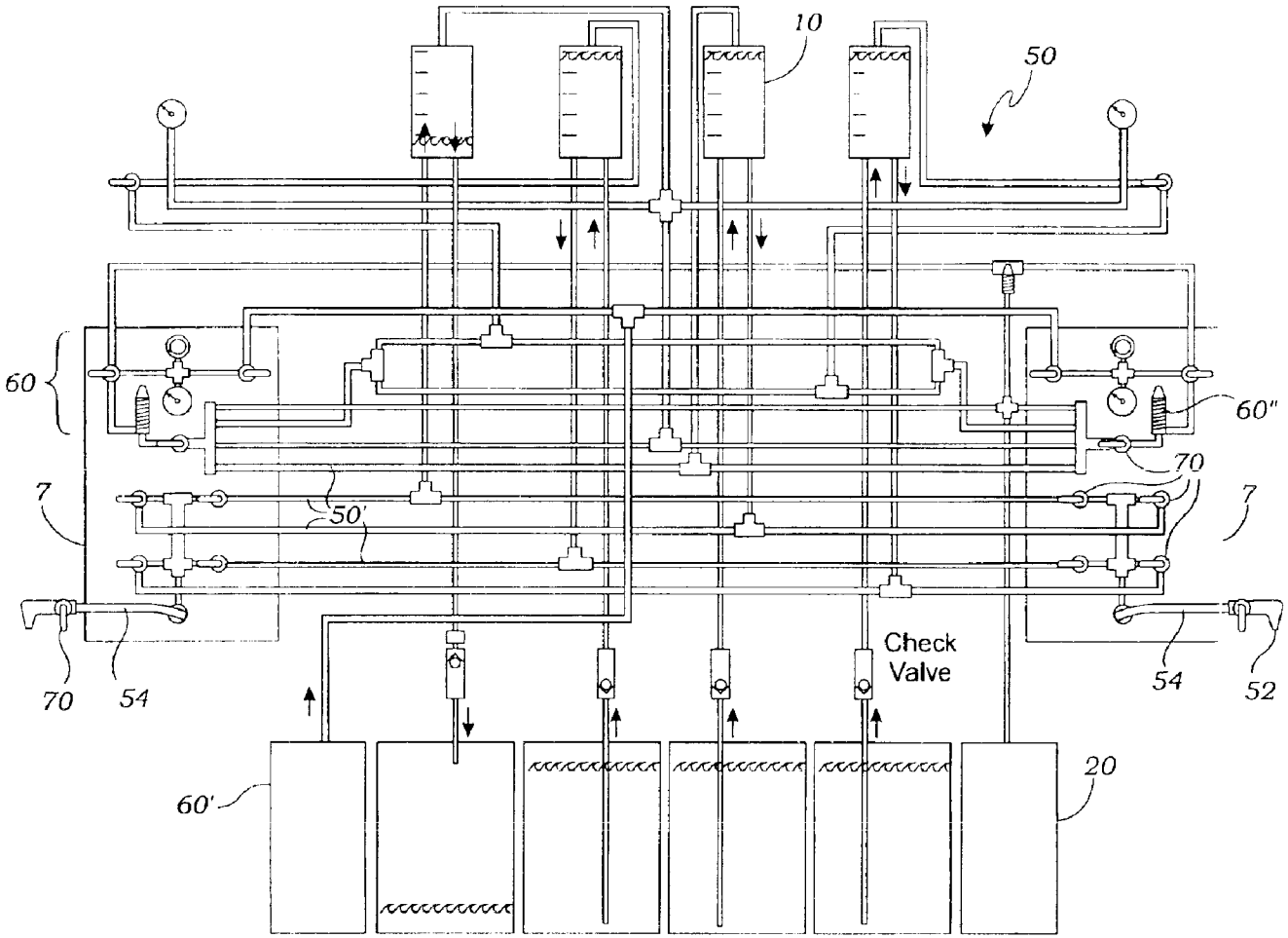
FIG. 3 is a schematic conduit diagram showing one alternative manner of interconnecting the several components of the invention for appropriate use as described in the following specification.

The present invention is a fluid exchange system including an apparatus and method of use. The apparatus includes a stationary control station 5 as best shown in FIG. 1. Plural first fluid containers 10 are mounted above, and preferably on top, of the control station 5 as would be easily accomplished by those of skill in the art. These first fluid containers 10 are preferably transparent or translucent so that one may monitor the fluid levels. Plural second fluid containers 20 are mounted below the control station 5, preferably below a driveway 30 enabling automotive vehicles 40 access to the control station 5. Preferably the control station 5 is mounted on, and is fixed to, the driveway 30 or its appurtenances so that it (the control station 5) is not movable. A conduit means 50 such as a network of tubes and hoses, as shown schematically in FIG. 3, is interconnected with the first fluid containers 10, the second fluid containers 20 and the control station 5 for fluid transfer therebetween and for fluid interchange with at least two automotive vehicles 40 simultaneously. Clearly, the present invention may also provide only a single station, however, plural stations in such an apparatus provides great benefit and is a novelty of the invention. A means for developing suction and pressure 60 is interconnected with the conduit means 50 for driving fluids therethrough, and a means for switching 70 of fluid direction in the conduit means 50 is provided, again, as shown in FIG. 3. The switching means 70 may be any fluid valve device as is well known in the art. The suction and pressure developing means 60 may be a pump (not shown) or may be a source of compressed air 60', and/or may be a venturi device 60" as is also well known and clearly described in the references. The control station 5 preferably provides dual control panels 7 where each is enabled for servicing a vehicle 40, i.e., two vehicles 40 simultaneously. The latter capability is considered novel in the present invention. The control panels 7 are shown to be identical in FIG. 3, but they may be configured independently for the same or different services as desired.

Preferably, the conduit means 50 includes a means for sealing 52 of an automotive fluid system fill pipe 42 so as to hold vacuum in an automotive fluid system 54 such as a radiator. Such a seal may be a nozzle as shown in FIG. 3 and as described in the references.

Preferably, the control panels 7 are mounted vertically for improved access to the switching means 70 and are mounted, preferably, on opposing sides of the control station 5 for improved access by two vehicles 40. In this manner, two vehicles 40 may drive up to the station 5, be serviced at the same time and drive off thereafter without mutual interference.

Preferably, the conduit means 50 includes manifolds 52 that are common to the dual control panels. This is clearly shown in FIG. 3. This provides the advantage of enabling access of each of the control panels to selected fluids stored in the containers 10, 20, without undue conduit complexity.

The switching means 70 is preferably joined and connected for interconnecting any one of the manifolds 52 to a delivery hose 54 which is adapted for connecting with an automotive fluid system such as a cooling system, i.e., the radiator 42.

Clearly, as shown, the first 10 and the second 20 fluid containers are interconnected by the conduit means 50 for moving fluids therebetween.

In operation, the present method for fluid exchange comprises positioning the control station 5 for access by automotive vehicles 40, mounting the plural first fluid containers 10 on top of the control station 5, mounting the plural second fluid containers 20 below the control station 5, and interconnecting the containers 10, 20 and the control station 5 with the conduit means 50 for fluid transfer therebetween and for fluid interchange with the automotive vehicles 40. Specific fluid exchange methods for the several fluid systems in modern passenger cars and other vehicles are described in the references and the co-pending patent applications defined above. Suction and pressure are developed in the conduit means 50 for driving fluids therethrough. The fluids are moved to points of application or storage through the switching devices 70 described above so that fluids are available at the dual control panels 7 for servicing two vehicles simultaneously. Actually, more than two vehicles, i.e., three, four or more, maybe be serviced at the same time by simple elaboration of the principles described here.

The method further includes the step of sealing the automotive fluid system fill pipe or entry port and holding a vacuum in the fluid system of at least one of the automotive vehicles 40.

The method further comprises the step of vertically mounting the control panels 7 on opposing sides of the control station 5 for improved access, visibility and small footprint, a novelty of the invention.

The method further comprises the step of manifolding the conduit means 50 for common access to fluids at the dual control panels 7.

The method of further comprises the step of interconnecting any one of the manifolds 50' to the delivery hose 54 connected with an automotive fluid system 42.

The method further comprises the step of interconnecting the first 10 and the second 20 fluid containers and moving fluids therebetween so as to, for instance, move spent fluids in one of the first containers 10 to the second containers 20 which preferably are larger for greater storage capacity. Also, the second containers 20 may be used as storage for replacement fluids to replenish fluids depleted from the first containers 10. The use of fluids stored in first containers 10 provides the advantage of placing the first containers 10 above point of use so as to take advantage of gravity feeding of the fluids. Likewise, it is of great advantage to place the second containers 20 below point of use so that fluids may be drained into them using gravity feed. The present invention provides a superior approach to automobile maintenance in that the operator's hands and the facility's floor does not come into contact with the fluids used in today's automobile and industrial environment, many of which are detrimental to health.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fluid exchange apparatus comprising: a stationary control station; plural first fluid containers mounted above the control station; plural second fluid containers mounted below the control station; conduit means interconnecting the first fluid containers, the second fluid containers and the control station providing fluid transfer therebetween and providing fluid interchange with an automotive vehicle; means for developing fluid driving forces interconnected with the conduit means for driving fluids therethrough, and means for switching fluid in the conduit means; the control station providing at least two control panels enabled for servicing at least two vehicles simultaneously, the conduit means including manifolds common to the at least two control panels.

2. The apparatus of claim 1 wherein the conduit means includes a means for sealing a radiator fill pipe so as to hold vacuum in an automotive fluid system.

3. The apparatus of claim 1 wherein the control panels are mounted vertically on opposing sides of the control station.

4. The apparatus of claim 1 wherein the switching means is enabled for interconnecting any one of the manifolds with a delivery hose adapted for connecting with an automotive fluid system.

5. The apparatus of claim 1 wherein the first and the second fluid containers are interconnected for moving fluids therebetween.

6. The apparatus of claim 1 wherein the first containers are placed above a point of use so as to enable gravity feed of fluids therefrom.

7. The apparatus of claim 1 wherein the second containers are placed below a point of use so as to enable gravity feed of fluids thereto.

8. A method for fluid exchange comprising the steps of: positioning a control station for access by automotive vehicles; mounting plural first fluid containers above the control station; mounting plural second fluid containers below the control station; interconnecting the first fluid containers, the second fluid containers and the control station with a conduit means for fluid transfer therebetween and for fluid interchange with the automotive vehicles; developing suction and pressure in the conduit means for driving fluids therethrough; and interconnecting manifolds of the conduit means, commonly to at least two control panels for servicing at least two vehicles simultaneously.

9. The method of claim 8 further comprising the step of sealing a radiator fill pipe and holding a vacuum in a fluid system of at least one of the automotive vehicles.

10. The method of claim 9 further comprising the step of vertically mounting the control panels on opposing sides of the control station.

11. The method of claim 9 further comprising the step of interconnecting any one of the manifolds to a delivery hose connected with an automotive fluid system.

12. The method of claim 9 further comprising the step of interconnecting the first and the second fluid containers and moving fluids therebetween.

13. A fluid exchange apparatus comprising: a stationary control station mounted on, and fixed to, a driveway; plural first fluid containers mounted above the control station; plural second fluid containers mounted below the driveway, wherein the driveway enables automotive vehicles access to the control station; conduit means interconnecting the first fluid containers, the second fluid containers and the control station providing fluid transfer therebetween and providing fluid interchange with the automotive vehicles; means for developing fluid driving forces interconnected with the conduit means for driving fluids therethrough, and means for switching fluid in the conduit means; the conduit means, first and second containers, fluid driving forces developing means and fluid switching means enabled for servicing of at least two said automotive vehicles simultaneously.

* * * * *